US011631385B1

(12) United States Patent
McBride et al.

(10) Patent No.: US 11,631,385 B1
(45) Date of Patent: Apr. 18, 2023

(54) GUITAR SLIDE

(71) Applicants: Cole Eshee Heve McBride, Vancouver (CA); Andres Luciano Somasco, Nelson (CA)

(72) Inventors: Cole Eshee Heve McBride, Vancouver (CA); Andres Luciano Somasco, Nelson (CA)

( * ) Notice: Subject to any disclaimer, the term of this patent is extended or adjusted under 35 U.S.C. 154(b) by 0 days.

(21) Appl. No.: 17/681,686

(22) Filed: Feb. 25, 2022

(51) Int. Cl.
*G10D 3/00* (2020.01)

(52) U.S. Cl.
CPC ..... *G10D 3/00* (2013.01)

(58) Field of Classification Search
CPC ..... G10D 3/00
See application file for complete search history.

(56) References Cited

U.S. PATENT DOCUMENTS 2,466,344 A 4/1949 Wright
2,647,429 A 8/1953 Smith
3,638,525 A * 2/1972 Sciurba ..... G10D 3/00 84/322
3,741,065 A * 6/1973 Harris ..... G10D 3/00 84/319
3,822,629 A * 7/1974 Smith ..... G10D 3/00 84/319
3,854,368 A * 12/1974 Pogan ..... G10D 3/00 84/319
4,092,894 A * 6/1978 Clough, Jr. ..... G10D 3/00 84/319
4,328,733 A * 5/1982 Smith ..... G10D 3/00 84/319
4,817,488 A * 4/1989 de los Santos ..... G10D 3/00 84/319
4,969,382 A * 11/1990 Hein, III ..... G10D 3/00 84/319
D324,532 S 3/1992 Pearse
D360,647 S 7/1995 Jimenez
5,450,778 A * 9/1995 Roberts ..... G10D 3/00 84/319

(Continued)

FOREIGN PATENT DOCUMENTS

CN 103928014 A * 7/2014
CN 103928014 B 7/2016

(Continued)

*Primary Examiner* — Robert W Horn
(74) *Attorney, Agent, or Firm* — Quickpatents, LLC; Kevin Prince

(57) ABSTRACT

A guitar slide for use with a finger of a person on guitar strings of a guitar comprises a hollow body open at a first end and at a second end. The hollow body has an outside surface adapted for contacting the guitar strings of the guitar simultaneously, and an inside surface adapted to receive the person's finger therein. A spring clip is fixed with the inside surface of the hollow body and is adapted to pivot between a first position and a second position. The spring clip includes an urging mechanism to urge the spring clip into the first position. As such, the person inserts his finger into the hollow body, causing the spring clip to pivot towards the second position. The urging mechanism applies pressure to the person's finger to keep the guitar slide in place on the person's finger by friction, while the person plays the guitar.

14 Claims, 7 Drawing Sheets

(56) References Cited

U.S. PATENT DOCUMENTS

| | | | | | |
|---|---|---|---|---|---|
| 5,458,036 | A * | 10/1995 | Monaco | G10D 3/00 | 84/452 P |
| 5,515,762 | A | 5/1996 | Perkins | | |
| 5,981,856 | A * | 11/1999 | Story | G10D 3/00 | 84/319 |
| 6,111,177 | A * | 8/2000 | Pattillo | G10D 3/00 | 84/322 |
| D434,065 | S | 11/2000 | Morse | | |
| 6,160,212 | A * | 12/2000 | Morse | G10D 3/00 | 84/315 |
| 6,297,435 | B1 * | 10/2001 | Gutowski | G10D 3/00 | 84/307 |
| 6,748,764 | B1 | 6/2004 | Roemer | | |
| 7,476,792 | B1 * | 1/2009 | Musser | G10D 3/00 | 84/315 |
| 7,572,964 | B2 | 8/2009 | Sundby | | |
| D651,233 | S | 12/2011 | Bower | | |
| 8,247,674 | B2 | 8/2012 | Corts | | |
| 8,269,084 | B2 | 9/2012 | Ludwig | | |
| 8,618,391 | B1 * | 12/2013 | Roberts | G10D 3/00 | 84/319 |
| 8,802,948 | B2 | 8/2014 | Blakeney | | |
| 9,082,373 | B2 | 7/2015 | Kear | | |
| 9,975,372 | B2 | 5/2018 | White | | |
| 10,403,245 | B1 | 9/2019 | Flynn | | |
| D877,805 | S * | 3/2020 | McBride | D17/20 | |
| 10,741,150 | B2 | 8/2020 | Flynn | | |
| 2005/0045019 | A1 | 3/2005 | Wright | | |
| 2011/0192267 | A1 * | 8/2011 | Coleman | G10D 3/00 | 84/319 |
| 2015/0052944 | A1 | 2/2015 | Affolter | | |
| 2015/0090095 | A1 * | 4/2015 | Maldonado | G01D 3/00 | 84/315 |

FOREIGN PATENT DOCUMENTS

| | | | | | |
|---|---|---|---|---|---|
| GB | 1142487 | A * | 2/1969 | | |
| GB | 2366443 | A * | 3/2002 | G10D 3/00 | |
| GB | 2366443 | A | 3/2002 | | |
| WO | WO-2004095416 | A1 * | 11/2004 | G10D 3/00 | |

* cited by examiner

GUITAR SLIDE

CROSS-REFERENCE TO RELATED APPLICATIONS

This application is a continuation-in-part of U.S. Design patent application 29/800,897, filed on Jul. 23, 2021, and is incorporated herein by reference.

STATEMENT REGARDING FEDERALLY SPONSORED RESEARCH AND DEVELOPMENT

Not Applicable.

FIELD OF THE INVENTION

This invention relates to guitars, and more particularly to a guitar slide with a finger-retaining spring clip arrangement.

BACKGROUND

Guitar slides are well known in the art of guitar musical instruments, and allow a person to depress all of the guitar strings simultaneously with a single finger. Traditional guitar slides typically include a hollow cylinder through which the person inserts his finger. As the guitar slides are typically made for all sizes of fingers, often smaller fingers must be kept bent slightly to frictionally retain the guitar slide on the finger while playing. This can cause cramping and fatigue in the person's finger over extended periods. Further, if a person's finger is too large to allow bending within the hollow cylinder, sufficient friction between the finger and the guitar slide may not possible, and thus the guitar slide is often prone to slipping off of the person's finger while playing.

Therefore, there is a need for a guitar slide device that will fit a large variety of finger sizes, yet will also grip the finger sufficiently to be retained by the finger while playing. Such a needed invention would be retained on the finger without having to bend the finger to maintain enough friction between the finger and the guitar slide, reducing finger cramping and fatigue. The needed invention could be made in a wide variety of lengths and shapes, yet still be relatively inexpensive to manufacture and intuitive to use. The present invention accomplishes these objectives.

SUMMARY OF THE INVENTION

The present device is a first embodiment of a guitar slide for use with a finger of a person on guitar strings of a guitar. The guitar slide comprises a hollow body open at a first end and at a second end. The hollow body has an outside surface adapted for contacting the guitar strings of the guitar simultaneously. The hollow body includes a first peripheral edge at the first end thereof, and an opposing second peripheral edge at the second end thereof. The hollow body has an inside surface adapted to receive the person's finger therein.

A spring clip is fixed with the inside surface of the hollow body and is adapted to pivot between a first position and a second position. The spring clip includes an urging mechanism adapted to urge the spring clip into the first position.

As such, the person inserts his finger into the first end of the hollow body, causing the spring clip to pivot towards the second position. The urging mechanism applies pressure to the person's finger to keep the guitar slide in place on the person's finger by friction, while the person plays the guitar.

The spring clip is preferably fixed to the inside surface of the hollow body by a pair of pivot posts extending away from the spring clip. Each pivot post is rotatably engaged with a pivot recess formed in the hollow body.

The present invention is a guitar slide device that fits a large variety of finger sizes, yet also grips the finger sufficiently to be retained by the finger while playing. The present device can be retained on the finger without having to bend the finger to maintain friction between the finger and the guitar slide, reducing finger cramping and fatigue. The present invention can be made in a wide variety of lengths and shapes, yet still be relatively inexpensive to manufacture and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
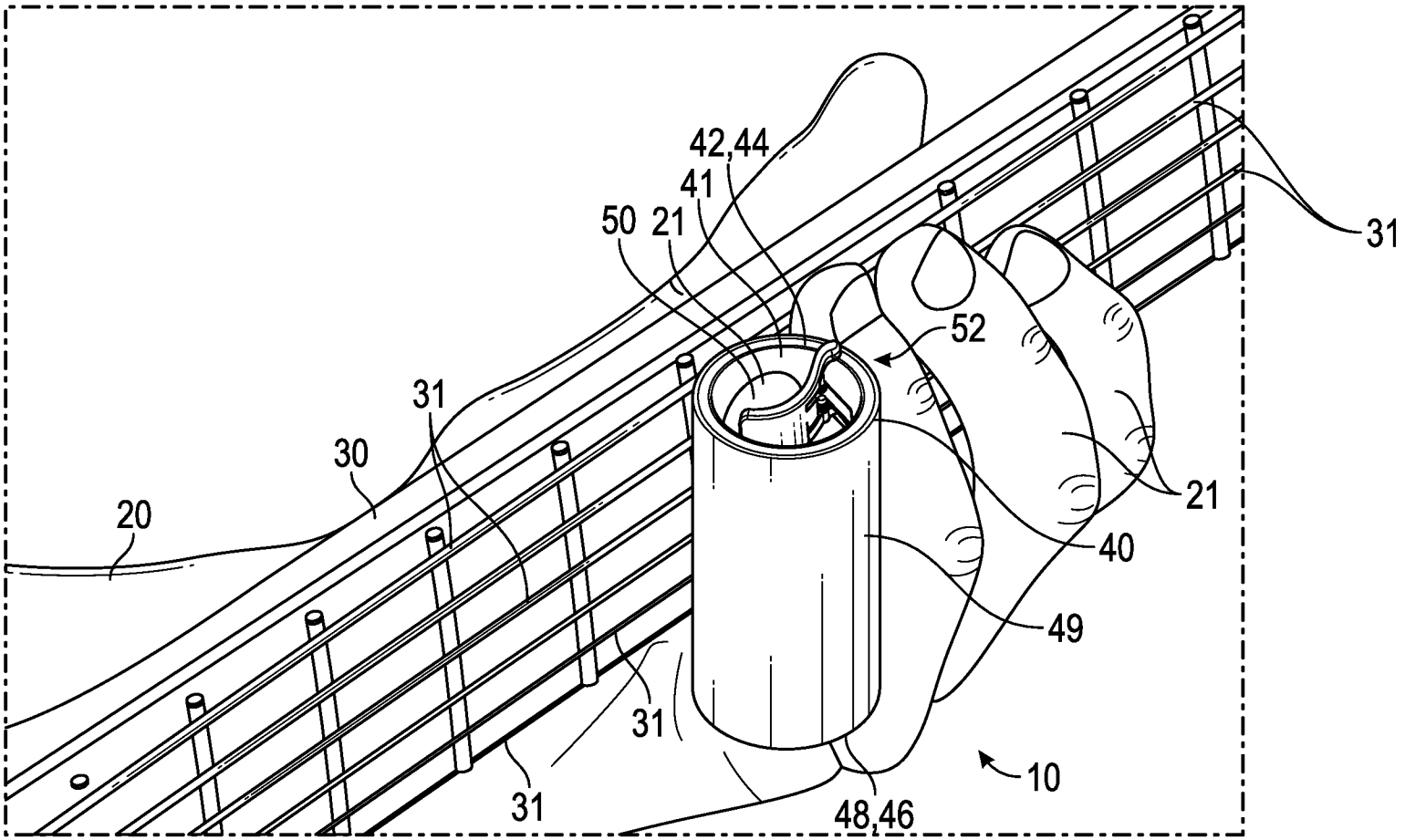
FIG. 1 is a front perspective view of the invention, showing a guitar slide of the present invention as used with a guitar by a person.
Figure 2:
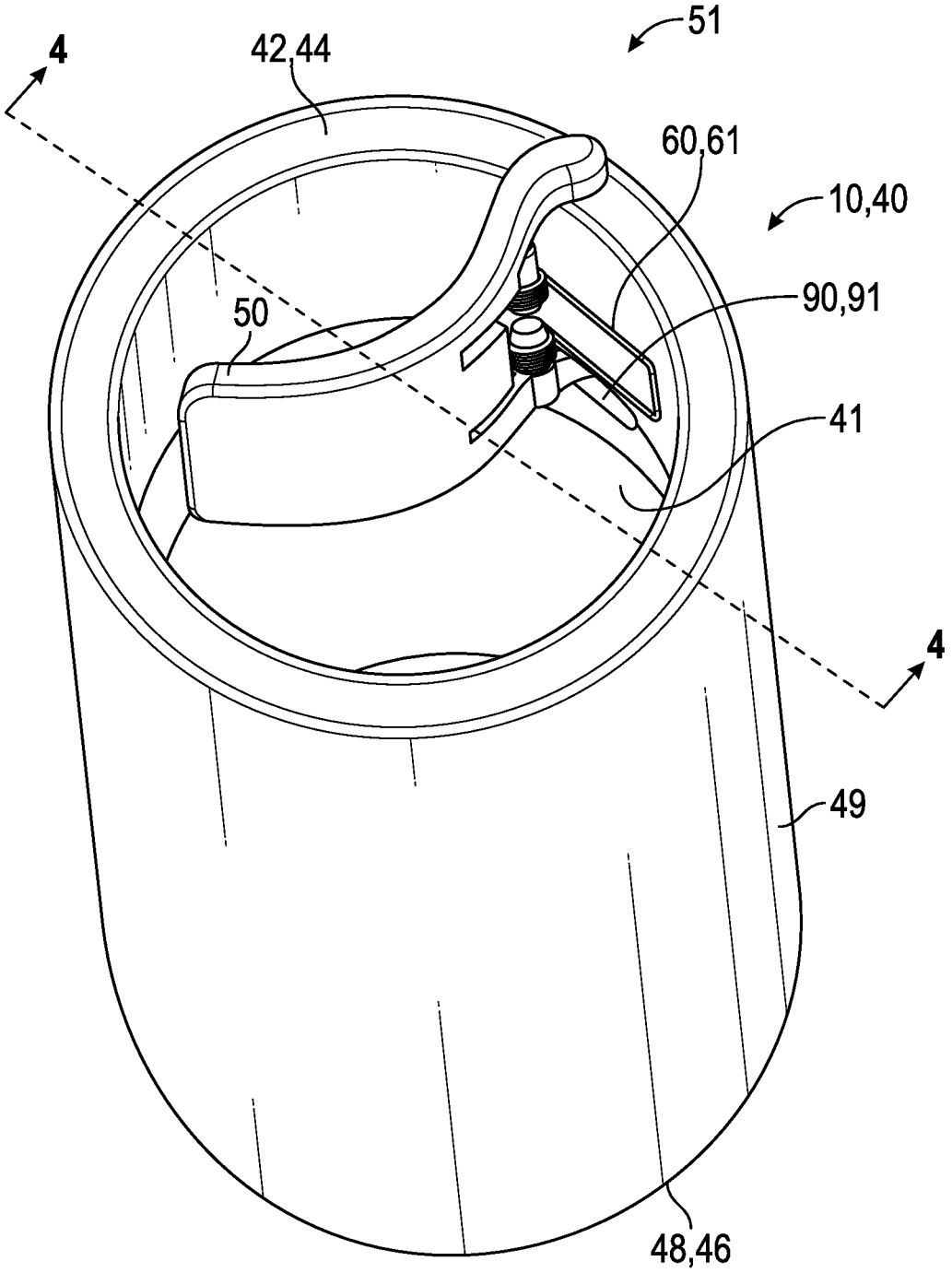
FIG. 2 is a top perspective view thereof.
Figure 3:
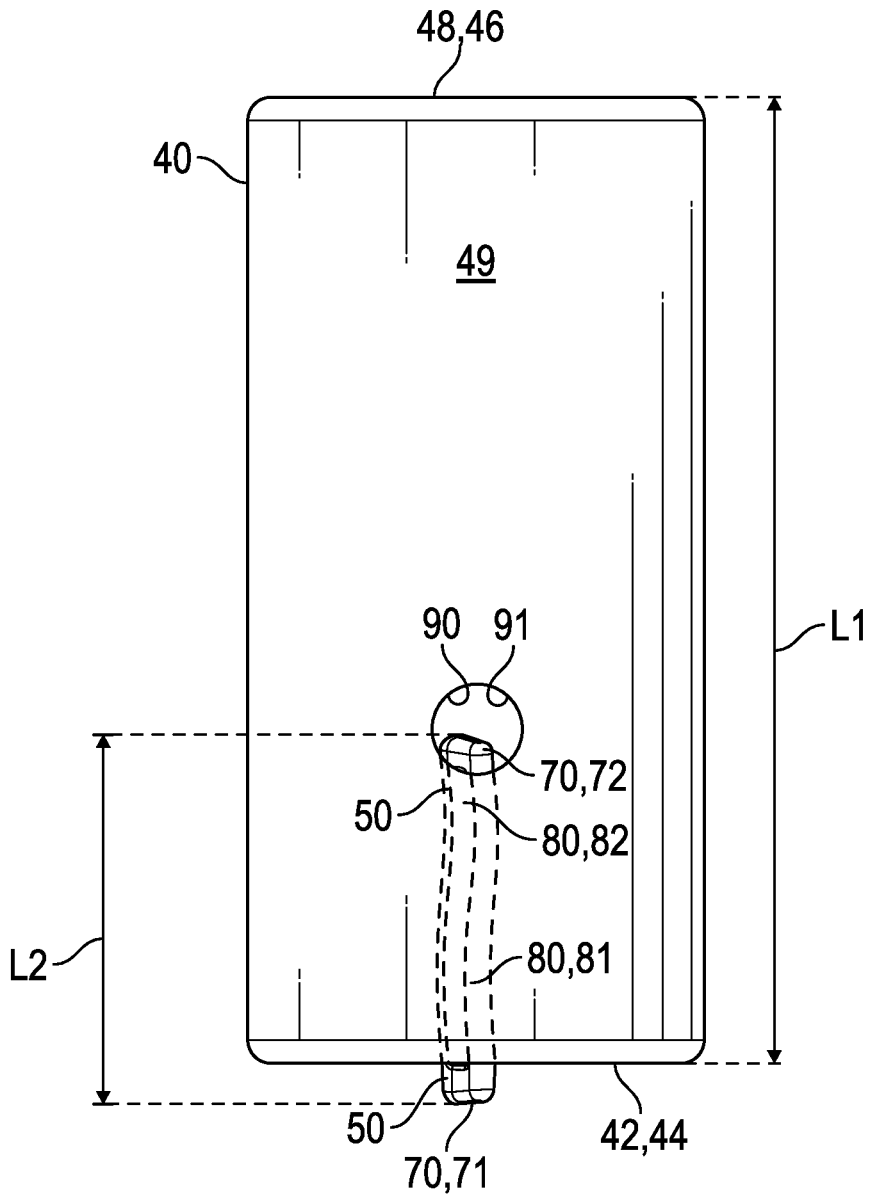
FIG. 3 is a front elevational view thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-5 illustrate a first embodiment of a guitar slide 10 for use with a finger 21 of a person 20 on guitar strings 31 of a guitar 30. It is understood that such a guitar slide 10 may be used with other stringed instruments as well, although not illustrated.

Figure 6:
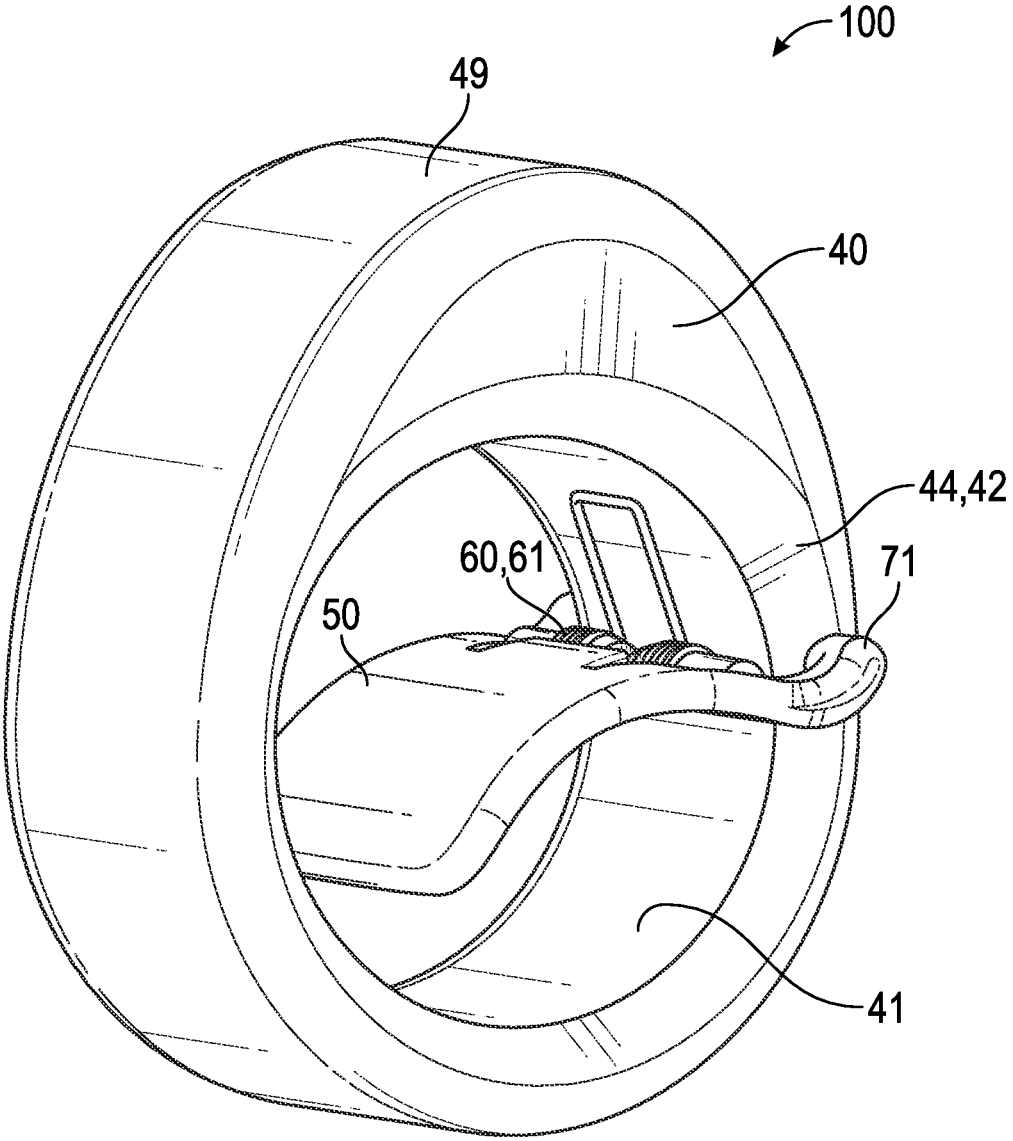
FIG. 6 is a front perspective view of an alternate embodiment of the invention.
Figure 7:
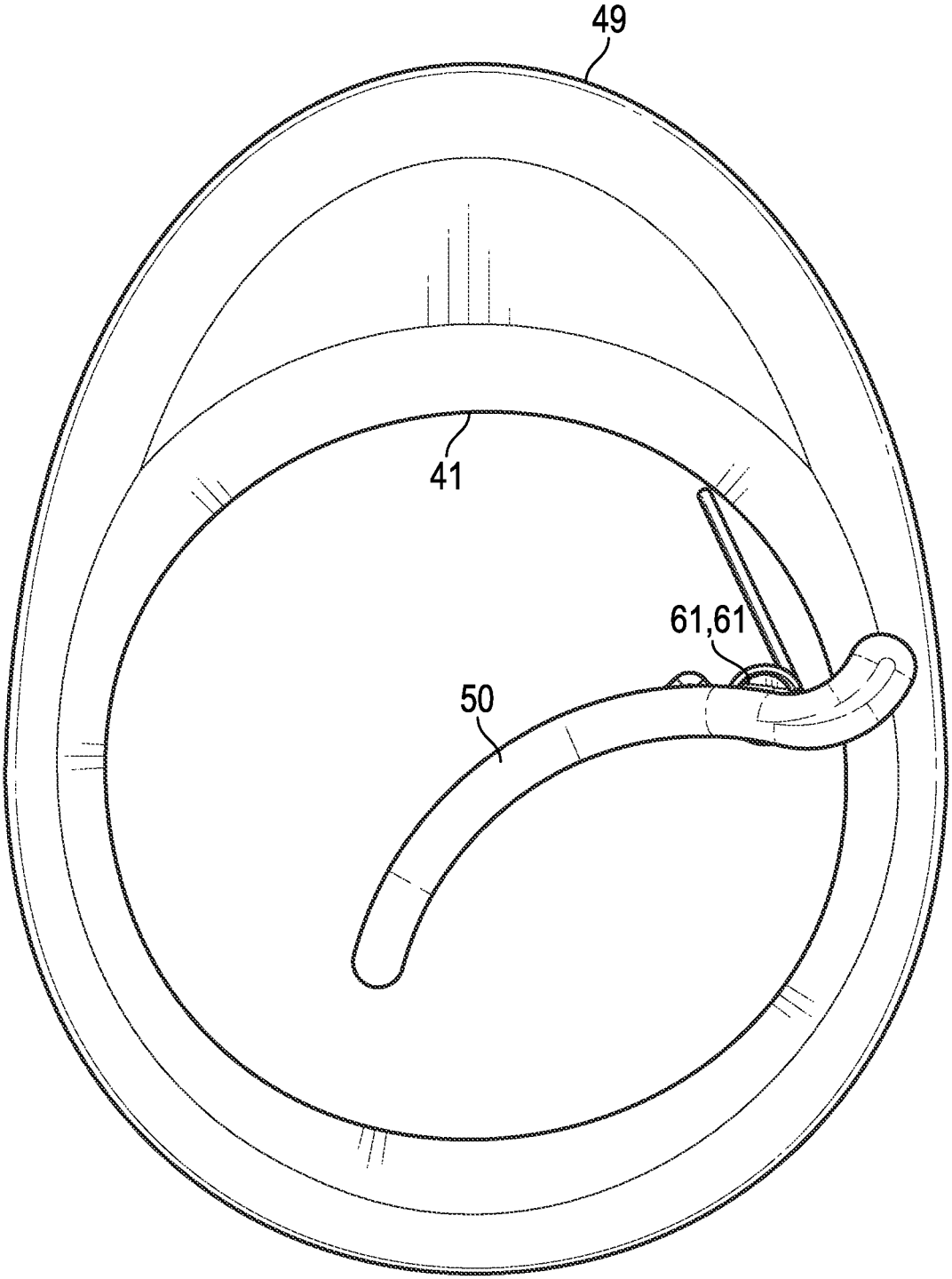
FIG. 7 is a front elevational view thereof.
Figure 8:
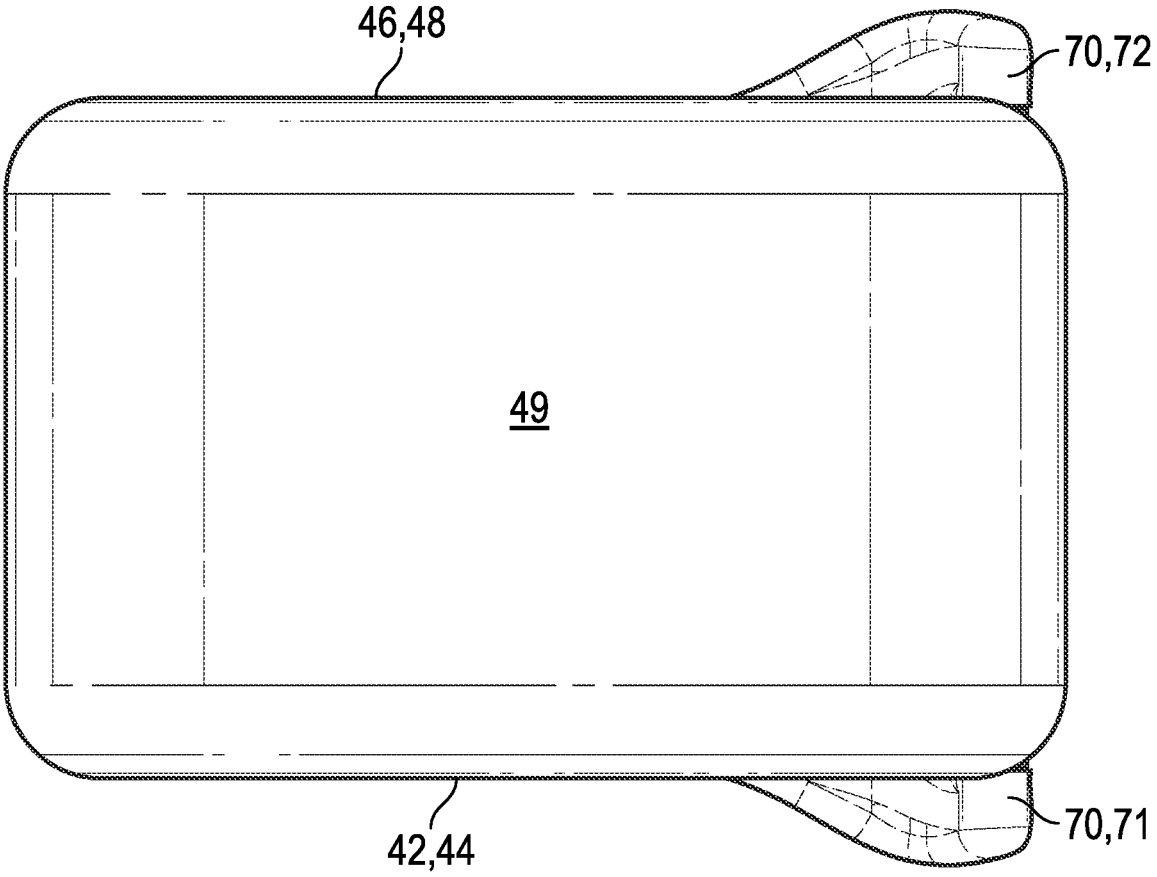
FIG. 8 is a top perspective view thereof.

The guitar slide 10 comprises a hollow body 40 open at a first end 42 and at a second end 48. The hollow body 40 has an outside surface 49 adapted for contacting the guitar strings 31 of the guitar 30 simultaneously. The hollow body 40 includes a first peripheral edge 44 at the first end 42 thereof, and an opposing second peripheral edge 46 at the second end 48 thereof. The hollow body 40 has an inside surface 41 adapted to receive the person's finger 21 therein. In the first embodiment the hollow body 40 has a length $L_1$ of greater than 1.5 inches. In a second embodiment, the hollow body 40 has a length $L_1$ of 0.5 inches or less. In some embodiments the hollow body 40 is cylindrical in shape (FIGS. 1-5), and in other embodiments the hollow body 40 is egg-shaped in cross-section (FIGS. 6-8).

A spring clip 50 is fixed with the inside surface 41 of the hollow body 40 and is adapted to pivot between a first position 51 and a second position 52. The spring clip 50 includes an urging mechanism 60 adapted to urge the spring clip 50 into the first position 51. The urging mechanism 60 is preferably a coil spring 61 (FIGS. 2, 4, 6, and 7). Alternately the urging mechanism 60 may be a block of a resilient material 62, such as a foam, sponge, or elastomeric material.

As such, the person 20 inserts his finger 21 into the first end 42 of the hollow body 40, causing the spring clip 50 to pivot towards the second position 52. While FIG. 1 illustrates that the person 20 has inserted his finger 21 into the second end 48 of the hollow body 40 for clarity of illustration, the person 20 can insert his finger 21 into either end 42,48 as desired. The urging mechanism 60 applies pressure to the person's finger 21 to keep the guitar slide 10 in place on the person's finger 21 by friction, while the person 20 plays the guitar 30.

The spring clip 50 is preferably fixed to the inside surface 41 of the hollow body 40 by a pair of pivot posts 70 extending away from the spring clip 50. Each pivot post 70 is rotatably engaged with a pivot recess 80 formed in the hollow body 40.

Figure 4:
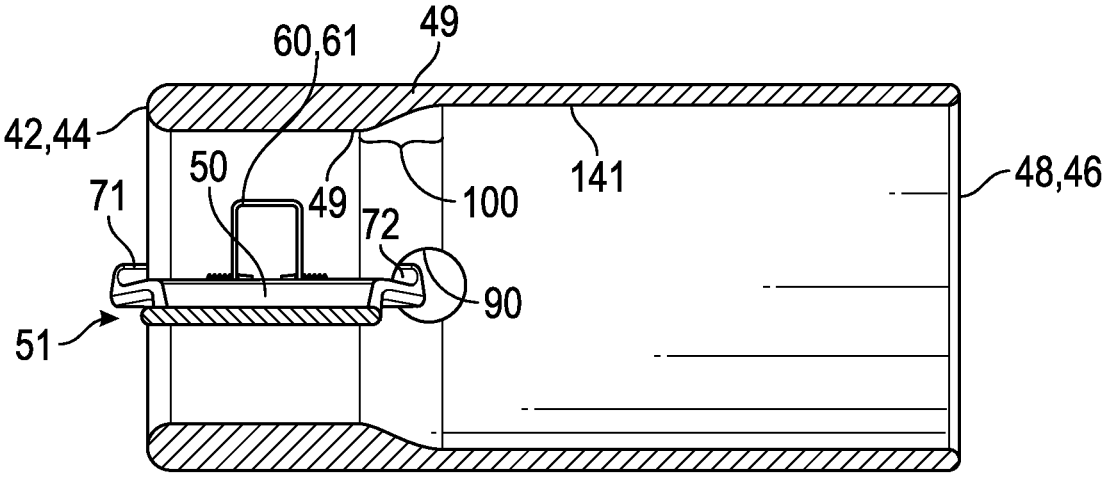
FIG. 4 is a cross-sectional view thereof, taken along lines 4-4 of FIG. 2.
Figure 5:
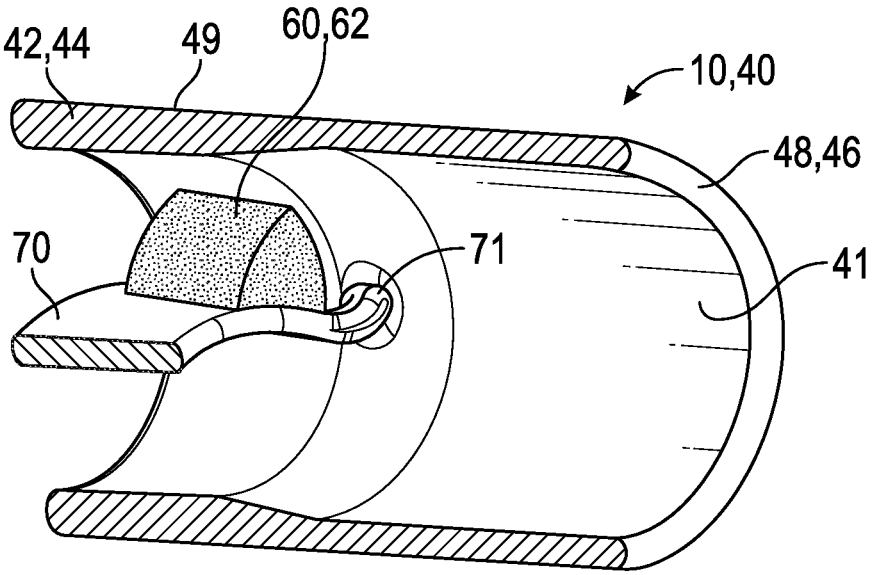
FIG. 5 is a perspective cross-sectional view of FIG. 4, illustrating an alternate embodiment of an urging mechanism.

In both the first embodiment and a second embodiment (FIGS. 6-8) of the invention, the spring clip 50 preferably has a length $L_2$ of 0.5 inches or less. In the first embodiment, the hollow body 40 includes a pivot aperture 90 through which one of the pivot posts 70 traverses. A first pivot post 71 is rotatbly engaged with a first pivot recess 81 of the pivot recesses 80 formed in the first peripheral edge 44 of the hollow body 40. A second pivot post 72 of the pivot posts 70 traverse the pivot aperture 90 and engage a second pivot recess 82 of the pivot recesses 80, formed in an aperture edge 91 of the pivot aperture 90 (FIG. 4). In the second embodiment, the second pivot recess 82 is formed in the second peripheral edge 46 of the hollow body 40.

In some embodiments the inside surface 41 of the hollow body 40 has a tapered section 100, which provides a thicker area of the hollow body 40 for forming the pivot recesses 80. Preferably the hollow body 40 is made from a rigid material such as metal, plastic, glass, or wood. The spring clip 50 is preferably also made of a rigid material such as metal, glass, plastic, or wood.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A guitar slide for use with a person's finger on guitar strings of a guitar, comprising:

a hollow body open at a first end and at a second end, the hollow body having an outside surface adapted for contacting the guitar strings of the guitar simultaneously, and an inside surface adapted to receive the person's finger therein; and a spring clip fixed with the inside surface of the hollow body and adapted to pivot between a first position and a second position, the spring clip including an urging mechanism adapted to urge the spring clip into the first position;

whereby the person inserts his finger into the first end of the hollow body, causing the spring clip to pivot towards the second position, the urging mechanism applying pressure to the person's finger to keep the guitar slide in place on the person's finger by friction while the person plays the guitar.

2. The guitar slide of claim 1 wherein the urging mechanism is a coil spring.

3. The guitar slide of claim 1 wherein the urging mechanism is a block of resilient material.

4. The guitar slide of claim 3 wherein the resilient material is a foam material.

5. The guitar slide of claim 3 wherein the resilient material is a sponge material.

6. The guitar slide of claim 3 wherein the resilient material is an elastomeric material.

7. The guitar slide of claim 1 wherein the hollow body is longer than 1.5 inches.

8. The guitar slide of claim 7 wherein the spring clip has a width of less than 0.5 inches.

9. The guitar slide of claim 1 wherein the hollow body includes a peripheral edges at the first end thereof and an opposing peripheral edge at the second end thereof.

10. The guitar slide of claim 9 wherein the spring clip is fixed to the inside surface of the hollow body by a pair of pivot posts extending away from the spring clip, each pivot post rotatably engaged with a pivot recess formed in each of the peripheral edges of the hollow body.

11. The guitar slide of claim 9 wherein the hollow body includes a pivot aperture through which one of the pivot posts traverses, a first of the pivot posts rotatably engaged with a pivot recess formed in the peripheral edge of the first end of the hollow body, and a second of the pivot posts traversing the pivot aperture and engaging an inside pivot recess formed in an aperture edge of the pivot aperture.

12. The guitar slide of claim 11 wherein the inside surface of the hollow body includes a tapered section, whereby a thicker area of the hollow body is available into which to form the pivot recesses.

13. The guitar slide of claim 1 wherein the hollow body is cylindrical in shape.

14. The guitar slide of claim 1 wherein the hollow body is egg-shaped in cross-section.

* * * * *